United States Patent [19]

Stout et al.

[11] Patent Number: 5,048,600

[45] Date of Patent: Sep. 17, 1991

[54] CONDENSOR USING BOTH FILM-WISE AND DROP-WISE CONDENSATION

[75] Inventors: Timothy R. Stout, Placerville; Floyd T. Wright, Fremont, both of Calif.

[73] Assignee: T & G Technologies, Inc., Cameron Park, Calif.

[21] Appl. No.: 598,013

[22] Filed: Oct. 10, 1990

[51] Int. Cl.[5] ..... F28B 1/00; F28F 13/04

[52] U.S. Cl. ..... 165/110; 165/133; 165/913

[58] Field of Search ..... 165/133, 110, 111, 913

[56] References Cited

U.S. PATENT DOCUMENTS

| | | | |
|---|---|---|---|
| 3,206,381 | 9/1965 | Neugebauer | 165/133 |
| 4,314,605 | 2/1982 | Sumitomo et al. | 165/110 |
| 4,700,771 | 10/1987 | Bennett et al. | 165/133 |
| 4,911,233 | 3/1990 | Chao et al. | 165/111 |

*Primary Examiner*—Albert W. Davis, Jr.

[57] ABSTRACT

A vapor is condensed onto a condensor whose upper portion promotes film-wise condensation and whose lower portion promotes drop-wise condensation. One embodiment of this invention uses a plastic condensing tube which has a metal condensor pipe inserted into the tube in its upper end. Grooves and aperatures in the wall of the pipe encourage the flow of condensate between the pipe and plastic tube to facilitate heat conduction between the two. Heat conduction between the plastic tube and metal pipe is facilitated by a liquid such as heat-sink grease. An alternate embodiment features a plastic-only heat condensor whose upper portion is treated to make it condense the vapor as a film and whose lower portion is untreated so as to condense the vapor as drops.

11 Claims, 6 Drawing Sheets

CONDENSOR USING BOTH FILM-WISE AND DROP-WISE CONDENSATION

This invention relates to condensing a vapor onto a condensor. More specifically, it relates to condensing a vapor onto a condensor whose upper portion promotes film-wise condensation and whose lower portion promotes drop-wise condensation. A preferred embodiment of this invention relates to use of a plastic condensing tube which has a metal condensor pipe inserted into the tube in its upper end. An alternative preferred embodiment features a plastic-only heat condensor whose upper portion is treated to make it condense the vapor as a film.

The information in this patent is an expansion of the U.S. patent application Ser. No. 7/461-246 filed Jan. 5, 1990, by Timothy R. Stout, one of the co-applicants of this application, and represents new material not included in that application.

BACKGROUND OF THE INVENTION

Condensors used to condense a vapor have widespread industrial usage and application. Steam condensors in power plants, stills for purifying water or alcohol, and chemical production stills represent a sample of the wide scope in which condensors are needed.

Depending on the relative value of surface tensions between a condensed vapor and a condensing surface, a vapor will tend to condense as a film or as discrete drops. Typically, when the condensate has a higher surface tension than the condensor wall, drop-wise condensation takes place, whereas if the condensor wall has a higher surface tension than the condensate, film-wise condensation occurs.

As an illustration, water has a typical surface tension of 72 dynes per square centimeter. Metals are usually much higher than this, whereas plastics are typically much lower. Thus, if water is condensed on a metal surface, it typically forms a film of water. If it is condensed onto a plastic surface, discrete drops of water are formed instead.

Neugebauer et al in their U.S. Pat. No. 3,206,381 document how that with vertically oriented surfaces film-wise condensation is very effective for low values of heat loading with their implied low temperature differentials across a heat exchanger wall. However, it begins to decrease in effectiveness as the temperature differential and heat loading is increased. On the other hand drop-wise condensation is very effective for large values of heat loading and their implied high temperature differentials. However, it becomes relatively ineffective as the heat loading and temperature differential is decreased. Neugebauer shows that for a typical heat exchanger the crossover point is at about fifteen Fahrenheit degrees difference. When the difference is greater than this, drop-wise condensation is most effective. When the difference is lower, film-wise is better.

Our understanding of the physical phenomenae causing the distinctions in behavior between the two forms of condensation is as follows. Condensate tends to act as an insulator. Thus, the condensation rate is greatest when the quantity of condensate between the condensor wall and the vapor to be condensed is at a minimum.

If condensation takes place as a film onto a vertically oriented surface, then gravity will cause a slow, downward flow of the fluid within the film, causing it to become thinner and thinner. If the rate of condensation is low enough, the film can be kept relatively thin such that a high heat transfer can be maintained at the condensor surface. However, as the temperature difference across the wall of the heat exchanger increases, the rate of condensation also increases. This results in larger and larger quantities of vapor being condensed into the film per unit time. As the condensation rate increases, the downward fluid flow within the film must carry an increasing quantity of condensate. Because of the viscosity of the condensate, the film becomes increasingly thick, which in turn results in a lower heat transfer capability.

On the other hand when the condensation takes place as drops, a different mechanism takes places. The condensor surface is either dry or covered with a drop. When a drop grows in size such that two drops touch, they combine to form a single, larger drop; however that larger drop may actually have a smaller surface area on the condensor than did the two single drops. This is because the condensate within the drops attract each other more strongly than they are attracted by the surface. The dry portions of the condensor surface have a very, very high coefficient of thermal conductivity, far higher than that of a film-wise condensor no matter how slowly it is operating and how thin the film is. As long as the drops remain small enough, the rate of conductivity through the drops is also very high. However, as the drops get larger and larger, the heat transfer rate starts to slow down. With water drops on a polyethylene surface it is our observation that the drops need to reach approximately ⅛ inch in size before they begin to flow of their own accord. Yet, it only takes about one-thousandth of an inch of condensate to begin impacting significantly the overall thermal conductivity.

Once a drop begins to flow, it will flow very rapidly, up to about five feet per second. As it flows down its path, it combines with all the other drops, large and small, it meets and the combination flows together down the surface, again at a rapid rate. The surface is mostly dry after a drop has flowed over it, because the condensate in the drops are attracted to each other more strongly than they are attracted to the surface. One may think of a drop as "washing" a surface clean of condensate as the drop passes by. As long as a steady supply of drops is supplied to a portion of the condensor, that portion will be kept washed of condensate and have a high heat transfer rate. However, if an insufficient supply is provided, then that portion will begin to collect larger and larger drops, and its effective heat transfer is significantly reduced. Basically, the lower portions of a drop-wise condensing surface of a heat exchanger are dependent upon the flow of drops from above to keep them washed clean.

When the temperature difference across the heat exchanger walls is high, it is still possible to have enough heat flowing through the drops to maintain a reasonable rate of vapor condensation into the drops; thus it is possible to generate a steady supply of drops in the upper portion of the heat exchanger which can in turn be used to keep the lower portions washed clean and have their super high transfer rate.

However, when the temperature difference begins to decrease, it takes longer and longer to form drops at the upper surface which are large enough to flow. This results in the lower surfaces not being washed frequently enough to be mostly dry and having only a few drops, with those being quite small. Thus, the size of the drops increases in the lower portion and the overall heat transfer coefficient starts to drop off. With really small temperature differences, such as ½ to 1 Fahrenheit degree, the production rate of the falling drops is virtually non-existant. This results in drops forming in the lower portion of the heat exchanger which are too large to transfer heat efficiently but are too small to flow of their own accord. As a result, the overall heat transfer coefficient drops to a useless value.

A condensor which accomodates drop-wise condensation throughout its length may be thought of as divided into two portions, an upper and a lower. The upper portion functions primarily as a drop generator and does not have very high thermal conductivity. The lower functions as the primary heat transfer means and gets washed too frequently to ever generate its own drops.

Plastic condensors have been known in the art for several decades, beginning with Elam in his U.S. Pat. No. 3,161,574, issued in 1963. A plastic condensor can cost less than one percent of an equivalent one made of metal. The typical environment of a condensor is free of ultra-violet light and oxygen; within this environment plastic can outlast metal. Yet, in the commercial marketplace metal, not plastic, is the preferred construction material.

We believe the primary reason for the failure of plastic to function satisfactorily as a condensor is related to its tendency to condense vapors, particularly water vapors, as drops instead of films. In general plastic condensors will need to have low pressure differences across their surfaces. This typically means a low temperature differential across their surfaces. A low temperature differential means low heat loading, and the condensor is attempting to work in that region in which drop-wise condensation is extremely inefficient.

SUMMARY OF THE INVENTION

Plastic condensors actually have very good heat transfer even with low temperature differentials so long as the drops are kept very small, such as under a mil in diameter.

If a drop-wise condensor has a high value of heat loading, the uppermost portion of the condensor will act as a drop generator and the lowermost portion as a highly effective region of heat transfer. However, since the drop generator is ineffective with low heat differentials, then whenever the condensor has a low value of heat loading it becomes important to supply drops from a source other than the drop-wise condensing surface. When this indeed is done, a drop-wise condensor can be quite effective even with a very low temperature differential, such as ½ to one Fahrenheit degree. In the aforementioned patent application by co-applicant Mr. Stout, drops are artificially supplied to the condensing surface from an artificial source; his application discloses the art of spraying or wicking a washing fluid onto the uppermost portion of the condensor in sufficient quantity for it to flow freely down the condensor and remove or "wash away" any drops of condensate which are met enroute.

In the current application drop generation is accomplished by using a wettable condensing surface in the upper portion of the condensor; the wettable surface will feature film-wise condensation and will work very efficiently with low heat loading across the condensor walls. The condensate from the film-wise portion of the condensor is then applied as drops to the drop-wise portion of the condensor; The downward pull of gravity on the condensate is sufficient to transfer the drops from one portion of the condensor to the other and to maintain a downward flow on the lower portion.

The primary advantage of the current application is that the drops are generated by an upper portion of the condensor itself; the nozzles, wicks, tubes, and pumps of Mr. Stout's earlier invention may be eliminated, resulting in lower manufacturing and maintenance costs.

If a plastic tube is used as the main condensing element in a condensor, then there are two convenient ways to change the uppermost portion of the tube from functioning as a drop-wise condensor to a film-wise condensor. One approach is to treat the uppermost portion of the tube to render it wettable, thus changing the method of condensation from drop-wise to film-wise. Smith, in his U.S. Pat. No. 4,515,210 discloses a method of doing this. A second approach is to insert a metal pipe into the uppermost portion of the tube. Film-wise condensation will take place on the surface of the pipe. Then the condensate will flow down the pipe and onto the plastic condensing surface where its continued downward flow washes drops of condensate from the plastic condensing surface.

Condensing plates are also known to the art. It is anticipated that one of normal skill in the art can readily apply the principals we disclose with tube condensors to plate condensors.

LIST OF REFERENCE NUMBERS

10—condensor
12—tube
14—distribution manifold
16—vapor
18—drops
20—lower surface
22—film
24—upper surface
26—boundary
28—washing fluid
30—mixed drops
32—dry region
34—upper nipple
36—upper tube sheet
38—cement
40—heat absorbing fluid
42—lower nipple
44—lower tube sheet
46—exhaust manifold
48—product condensate
50—pump
52—condensate outlet
60—tank 62—gas
64—hose
66—valve
68—connector
69—clamp
70—pipe
72—upper portion of tube 12
74—cement
76—liquid
78—grooves
80—tightly-fitting regions
82—aperatures

DESCRIPTION OF THE PREFERRED EMBODIMENTS

Figure 1:
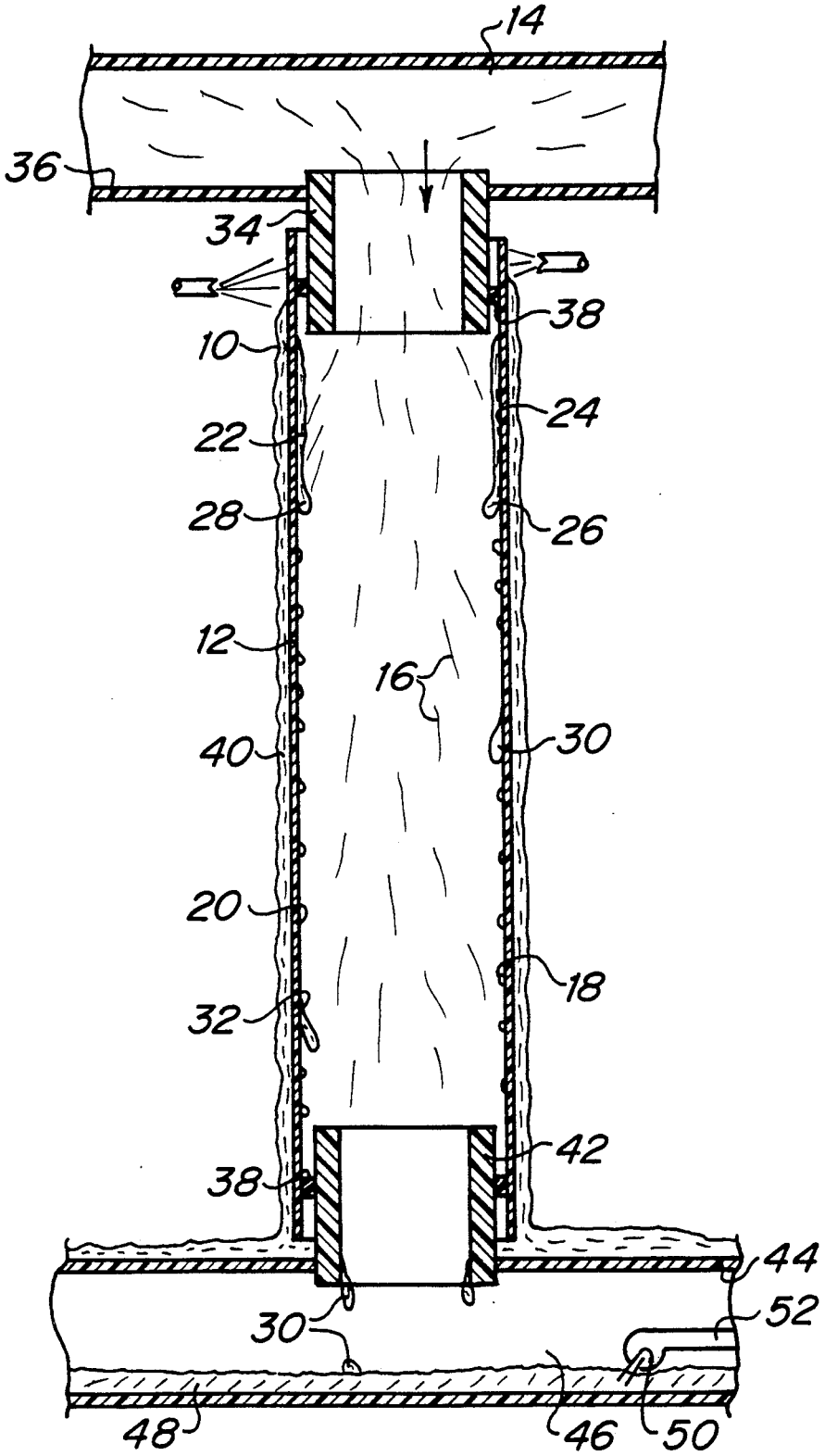
FIG. 1 is a cross-sectional view of an embodiment of the invention.

In FIG. 1 we see the simplest form of a hybrid film-wise and drop-wise condensor 10, the primary component of which is a plastic condensing tube 12. Distribution manifold 14 directs a vapor 16 to the interior of tube 12, where it condenses as drops 18 on the lower surface 20 of tube 12 and as a film 22 on the upper surface 24 of tube 12. Boundary 26 identifies the transition between upper surface 24 and lower surface 20.

Since tube 12 is made of plastic, it is naturally hydrophobic and unwettable by water. If vapor 16 consists entirely of steam, then the condensation on lower surface 20 will occur naturally as drops. In order to promote film-wise condensation on upper surface 24, surface 24 must be specially treated to become hydrophilic and wettable, as discussed later in the description for FIG. 2.

The condensate in film 22 freely flows down upper surface 24 under the influence of gravity until boundary 26 is reached, where the flow stops and collects as drops of washing fluid 28. Because lower surface 20 is unwettable, drops will not flow freely down it until they reach a certain minimum size, typically of at least one-eighth of an inch in diameter. Eventually the drops of washing fluid 28 collecting at boundary 26 become large enough so that the force of gravity will cause them to break loose from the film 22 and flow as drops onto and down lower surface 20. As washing fluid 28 flows down surface 20, it will combine with the drops 18 it meets along its path, and will mix with them to form mixed drops 30. Mixed drops 30, being larger than the drops of washing fluid 28 which were already large enough to flow under the influence of gravity down lower surface 20, will continue their downward flow on lower surface 20.

Notice that as mixed drops 30 flow down lower surface 20, they leave behind a dry region 32 which has been washed substantially free of drops. Dry region 32 will exhibit extremely high thermal conductivity, allowing new drops 18 to rapidly reform.

Tube 12 is mounted on upper nipple 34 which in turn is inserted into upper tube sheet 36. Upper tube sheet 36 acts as the lower portion of distribution manifold 14. Cement 38 allows a vapor-tight fastening of tube 12 to nipple 34. Upper nipple 34 is typically made of a plastic material so as to be resistant to corrosion from the heat absorbing fluid 40 which flows on the outside of tube 12.

Tube 12 is also mounted on lower nipple 42, with cement 38 making a vapor-tight connection here as well. Lower nipple 42 is inserted into lower tube sheet 44, which also acts as the upper portion of exhaust manifold 46. Mixed drops 30 flow down lower surface 20, onto and down the length of nipple 42, and then eventually drop into and become a part of product condensate 48 which has collected at the bottom of exhaust manifold 46. As shown, product condensate 48 flows into pump 50 to increase its pressure for removal from the condensor through condensate outlet 52. Lower nipple 42 is also typically made of plastic for corrosion resistance.

Figure 2:
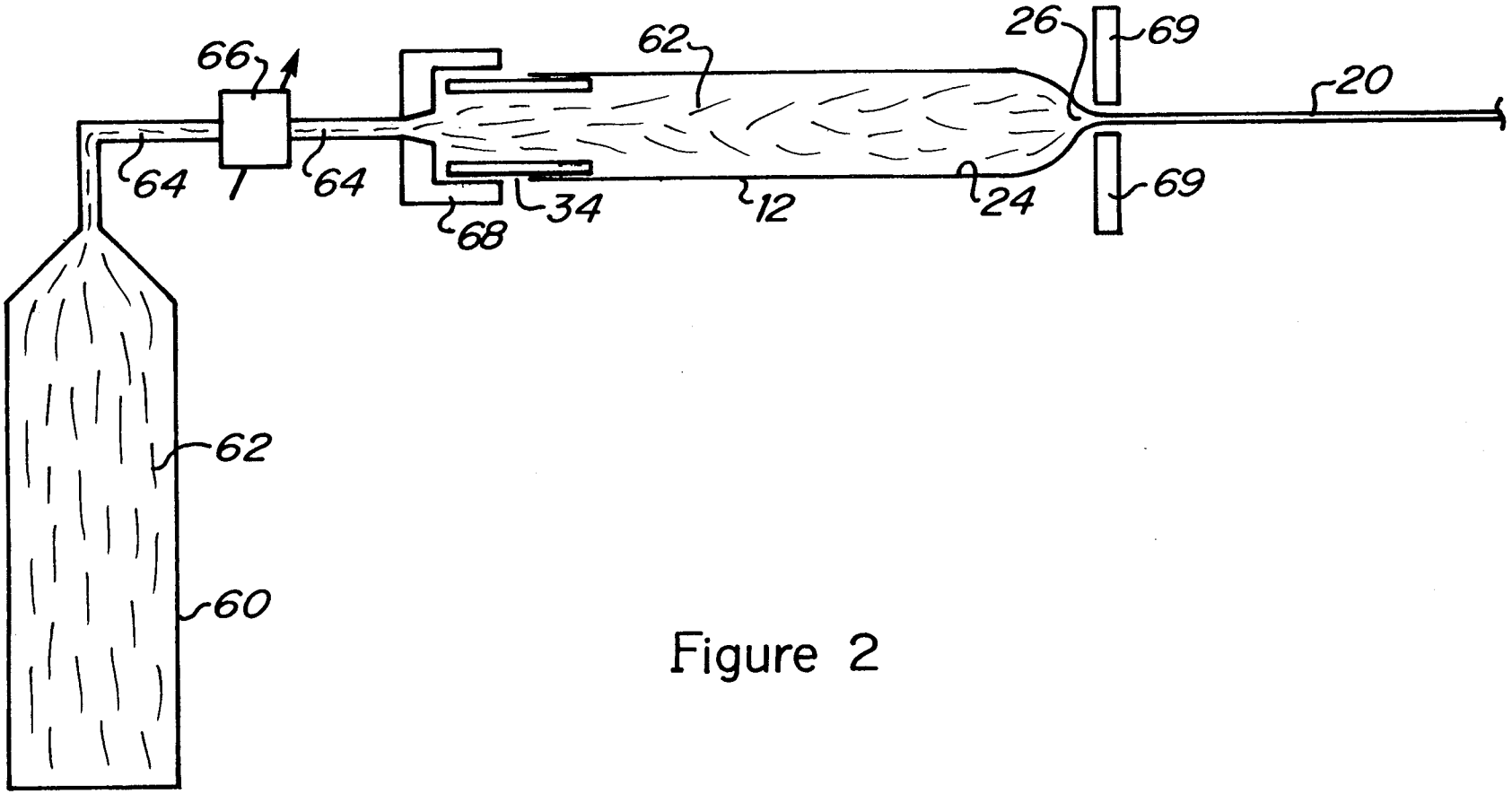
FIG. 2 is a diagrammatic view of a process to manufacture a tube used in the embodiment of FIG. 1.

In FIG. 2 we show a means of rendering upper surface 24 of tube 12 wettable with respect to water vapor. A tank 60 stores a strongly oxidizing gas 62 which, when exposed to said upper surface 24 will render it wettable. If tube 12 is made of polyethylene plastic, then sulfur trioxide is an appropriate gas to use for gas 62, as disclosed by Smith in his U.S. Pat. No. 4,515,210. A hose 64 conveys gas 62 from tank 60 through a valve 66 to a connector 68, from where gas 62 then flows through upper nipple 34 and on into tube 12. Valve 66 is used to control the flow of gas 62 through hose 64. Connector 68 is shaped to provide a temporary vapor-tight connection with upper nipple 34. Tube 12 is clamped shut by clamp 69 at the location of boundary 26. Thus, gas 62 will not be allowed to reach and thereby treat lower surface 20.

To treat upper surface 24 of tube 12 with gas 62, tube 12 is first squeezed flat to remove most of the air contained within it. Then Upper nipple 34 is inserted into connector 68 such that a vapor-tight connection is established between the two. Next, valve 66 opens and allows gas 62 to flow through hose 64 and into tube 12. It is assumed that valve 66 is a regulating valve and has been set for the pressure appropriate for gas 62 while treatment is within tube 12 between gas 62 and the upper surface 24 of tube 12. After several minutes, when the treatment is complete, valve 66 is closed and upper nipple 34 is removed from connector 68.

Not shown is a means of first removing the used gas 62 from tube 12 before removing upper nipple 34 from connector 68. If safety concerns or environmental regulations require this to be done because of the composition used for gas 62, we assume that one skilled in the art could design a mechanism to do this quite readily.

Figure 3:
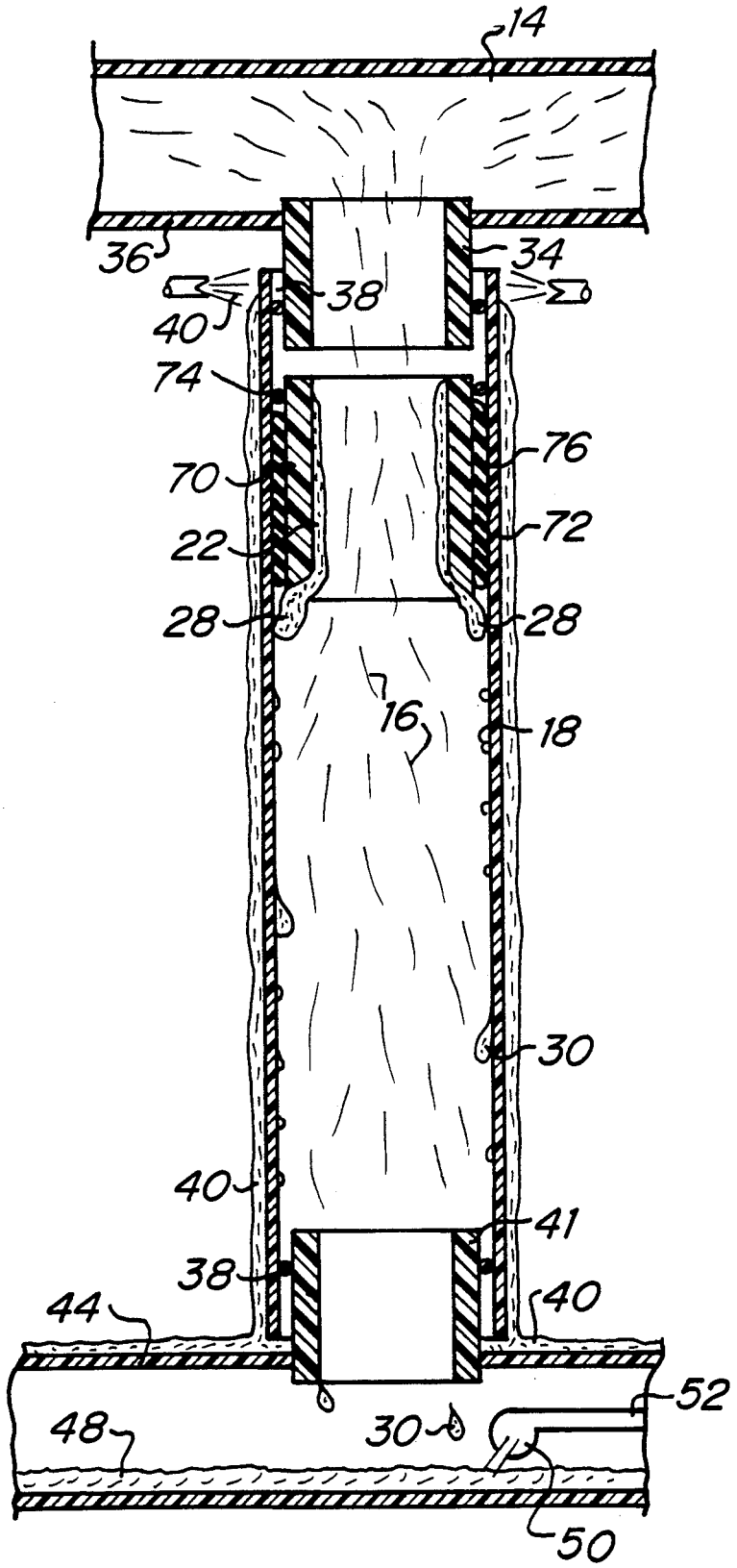
FIG. 3 is a cross-sectional view of a second embodiment of the invention.

In FIG. 3 we show an alternative embodiment of a condensor, wherein a pipe 70 made of a material wettable with respect to vapor 16 is inserted in the upper portion 72 of tube 12 in lieu of the treatment means which was used on upper surface 24.

If vapor 16 is steam, pipe 70 will typically be aluminum, which is light, cheap, has good thermal conductivity, and is not attacked by distilled water. Of course there are many other suitable metals, such as copper, stainless steel, and titanium.

Vapor 16 will condense as film 22 on pipe 70. The condensate within film 22 will flow to the bottom end of pipe 70 and collect as washing fluid 28. When sufficient washing fluid 28 has collected at the bottom of pipe 70, a portion of it will break off as drops and slide down the surface of tube 12, combing with drops of condensate which have condensed on the surface of tube 12. The rest of the operation is similar to the first embodiment.

If the fit of tube 12 over pipe 70 is tight and pipe 70 is quite thin, such as with walls 0.050 inch or less thick, making it quite light, then the friction between tube 12 and pipe 70 is typically great enough to hold pipe 70 in place within tube 12 and no other means of securing it is needed. However, if it is desired, a dab of cement 74 may be used to fasten pipe 70 to tube 12 more securely. We have had satisfactory results in performance with pipe 70 two feet in length when tube 12 was about ten feet in length.

Figure 4:
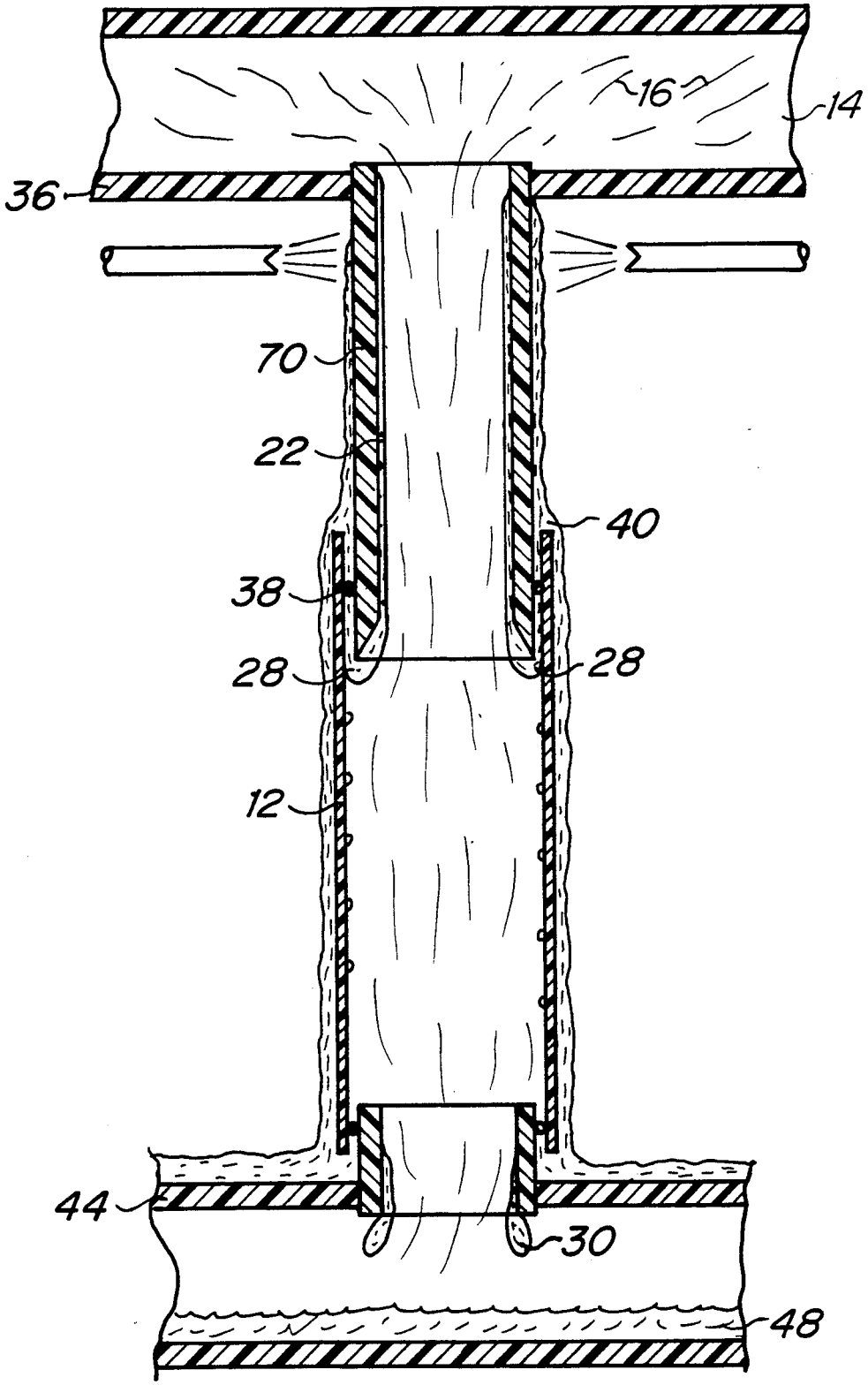
FIG. 4 is a cross-sectional view of a third embodiment of the invention.

Since upper nipple 34 is normally exposed to heat absorbing fluid 40, if pipe 70 can be attacked and corroded by fluid 40, it is preferred to use a seperate nipple 34 and place pipe 70 below it as illustrated. However, if pipe 70 is not attacked by fluid 40, then the embodiment of FIG. 4 may be preferred, wherein pipe 70 is extended out of tube 12 and is inserted into upper tubesheet 36 directly, thus eliminating the cost of a seperate nipple.

Liquids conduct heat much more effectively than gases and no matter how tight is the fit between pipe 70 and tube 12, there will be minute gaps at the near-molecular level between the two. These gaps will tend to be filled with vapor and thus will decrease the overall heat conductivity of the condensor. Filling the gaps with a liquid will thereby improve the conductivity. One way of improving the conductivity is to place a liquid 76 as shown in FIG. 3 between pipe 70 and tube 12. There are various silicone-based heat sink greases used in the electronics industry suitable for use here.

However, the condensate itself may be used to form such a heat-conducting liquid. In time vapor 16 will tend to penetrate between tube 12 and pipe 70, no matter how tight the fit. After penetration it readily condenses, such that the condensation itself becomes the liquid 76 and conducts heat between tube 12 and pipe 70 efficiently. However, the greater the length of pipe 70, the longer it will take liquid 76 to work its way between the entire surface area common to tube 12 and pipe 70.

Figure 5:
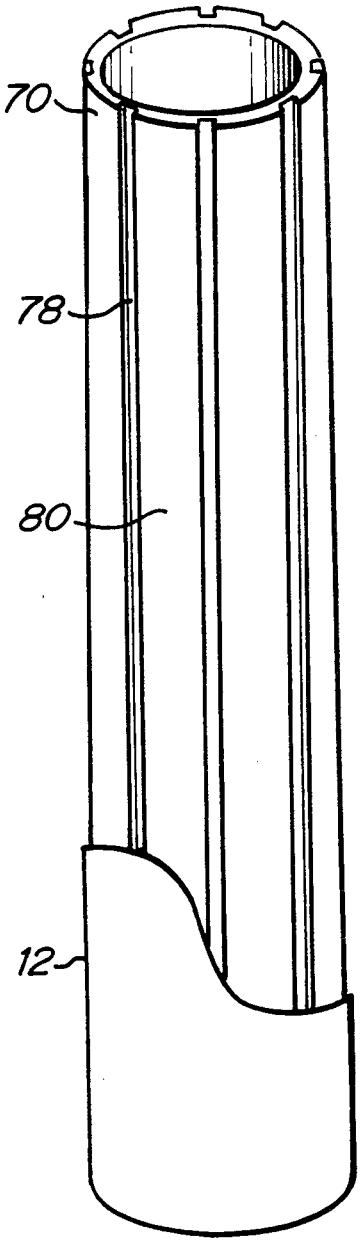
FIG. 5 is a side elevation view of an element used in FIG. 3

In FIG. 5 we show how we can speed this process up significantly by placing grooves 78 in the outside surface of pipe 70, thus providing a channel in which vapor 16 and liquid 76 may flow. A groove 10 mils deep by ten mils wide is adequate. Vapor 16 and liquid 76 will tend to flow much more readily within grooves 78 than between the "tightly fitting regions" 80 which lie between the grooves 78. In the tightly fitting regions 80 the tube 12 will be pressing tightly against pipe 70, thus inhibiting a free flow of vapor 16 or liquid 76, yet typically not tight enough to completely stop the flow. Then, liquid 76 will begin to spread from the grooves 78 into the adjacent, surrounding regions. If a pipe 70 is two feet long, has grooves 78 running its length, and has the grooves 78 placed every one-half of an inch, then the farthest it will be from at least one groove 78 to any point in a tightly fitting region 80 will be one-fourth of an inch. The time that it takes liquid 76 to flow within a groove 78 and then and additional one-fourth of an inch will be significantly less than the time it would take to flow over the entire outside surface area of pipe 70 if there were no grooves 78. Therefore, grooves 78 have the effect of speeding up the process of getting liquid 76 to spread between tube 16 and pipe 70, allowing the condensor to reach maximum thermal efficiency in a significantly shorter period of time.

Figure 6:
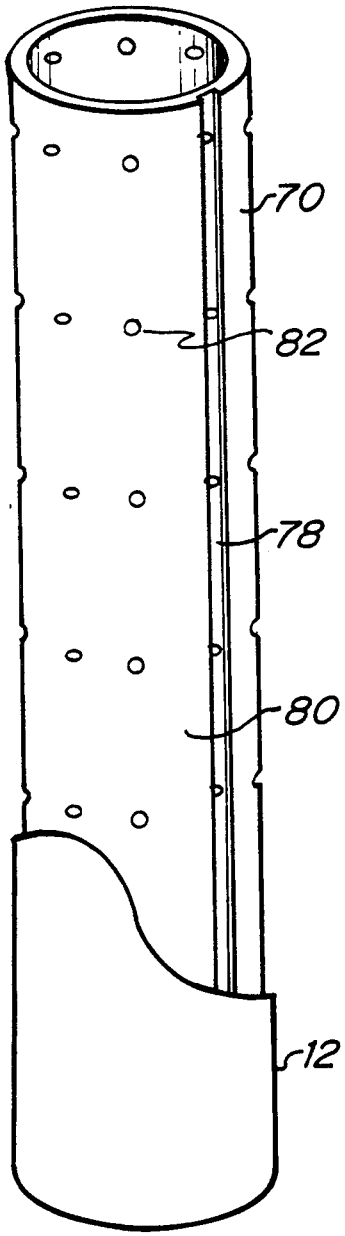
FIG. 6 is a side elevation view showing a variation in the element illustrated in FIG. 5.

In FIG. 6 we show how the same effect provided by grooves 78 can also be brought about by means of a set of aperatures 82 in pipe 70. The size of the aperatures is not critical, but we recommend approximately 1/16" in diameter. The improvement brought about by aperatures 82 is that liquid 76 needs only to diffuse a maximum distance equal to one-half the distance between aperatures, not a distance equal to at least half of the length of the pipe. Again, this signficantly reduces the time it takes for the condensor to reach maximum operational efficiency.

Also shown in FIG. 6 is our preferred embodiment to promote flow of liquid 76 between tube 12 and pipe 70. Grooves are cheaper to manufacture than holes are to drill. Yet, until the grooves themselves are first filled with vapor 16 and liquid 76, they are ineffective in distributing vapor 16 and liquid 76 to the tightly-fitting regions 80. If aperatures 82 are placed within grooves 78 along their length, the grooves 78 become effective quicker than without aperatures 82 and fewer aperatures 82 are needed than without grooves 78.

Finally, it should be pointed out that a groove 78 which runs the length of pipe 70 which has no aperatures 82 will be at least slightly effective even if the groove is completely closed at its ends, not having a free path in which vapor 16 may enter. That is because once vapor 16 and/or liquid 76 reaches the groove 78, having diffused through a tightly fitting region 80, vapor 16 and liquid 76 may then flow much more freely within groove 78 to regions yet without liquid 76 than if diffusion through a tightly fitting region 80 were required for the entire distance. Yet, it is obviously recommended that grooves 78 extend to at least one end of pipe 70 such that vapor 16 may freely enter at that end, and furthermore, in accordance with the above paragraph, if pipe 70 is relatively long, to also place aperatures 82 within grooves 78 along their length.

Figure 7:
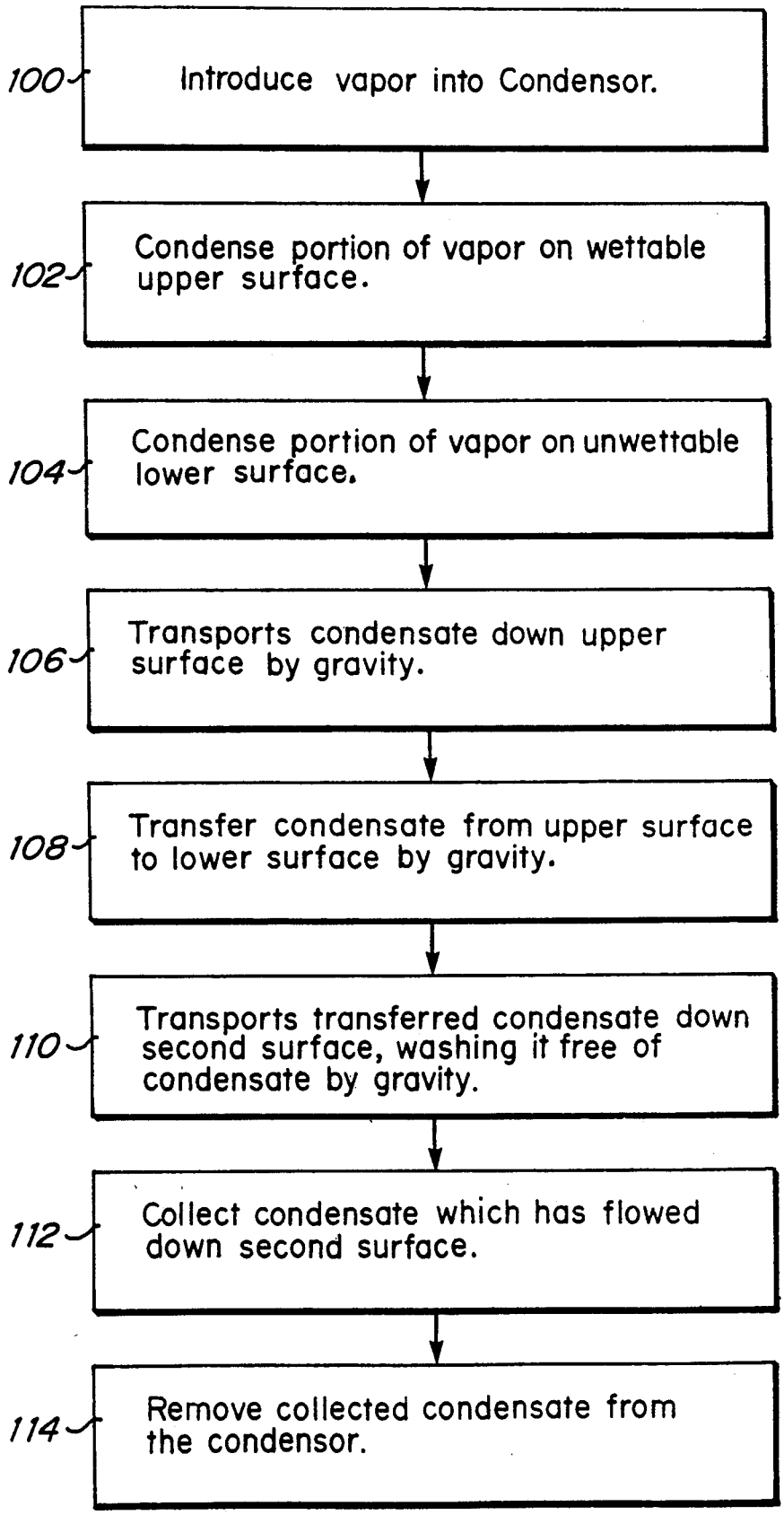
FIG. 7 is a flow chart showing a method of practicing the invention.

In FIG. 7 we show a method of condensing a vapor wherein at step 100 a condensible vapor is introduced into a condensor; the condensor is to feature an upper condensing surface which is wettable with respect to the condensed state of the vapor, such that the vapor condenses as a film on the upper condensing surface, and also features a lower condensing surface, which is unwettable with respect to the condensed state of the vapor, such that the vapor condenses as drops on the lower condensing surface.

In step 102 we condense a portion of the vapor as a film on the upper, wettable condensing surface; we call this condensate a washing fluid in recognition of its primary function which is made use of in a later step.

In step 104, we condense another portion of the vapor as drops on the lower, unwettable condensing surface.

In step 106, we use the pull of gravity to transport the washing fluid on the upper condensing surface downward, such that it collects at the lower boundary of the upper condensing surface. This transport of the washing fluid occurs as a flow of fluid within the film of condensate on the upper surface and merely results in the film becoming thinner, not being removed.

In step 108, we use the pull of gravity to break off drops of washing fluid from where the fluid has collected at the lower boundary of the upper surface and then transfer the drops to the lower surface. As washing fluid collects at the boundary between the upper and lower condensing surfaces, there will be opposing forces at work on the fluid. Gravity will exert forces on the washing fluid encouraging it to flow down the lower surface. However, the lower surface is unwettable and will resist the flow of drops. So, as more and more washing fluid collects at the boundary, the total downward force exerted on it by gravity increases until the downward force is to great for the repellant forces from the lower surface to resist. The washing fluid then is transferred onto the lower surface by gravity for its continued downward flow.

In step 110, we use gravity to transport the washing fluid which has been transferred onto the lower condensing surface down the length of the lower condensing surface. The repellant tendencies of the lower surface towards the washing fluid limit the flow of the washing fluid on the lower surface to a drop-wise flow.

As the drops of washing fluid flow down the lower surface, they combine with drops of condensate which condensed on the lower surface in step 104 and which are too small to flow of their own accord. However, the drops of washing fluid are already large enough to flow, and after combining with the smaller drops of condensate, the combination continues its way down the lower surface. Immediately after the washing fluid and any condensate it has combined with passes a portion of the lower condensing surface, that portion of the surface will be washed free of drops and have a very high rate of thermal conductivity.

In step 112 we collect the drops of combined washing fluid and condensate condensed on the lower surface after they have flowed downward together on the lower condensing surface; this collection of washing fluid and condensate condensed on the lower surface we call a collected condensate.

In step 114 we remove the collected condensate from the condensor, typically by pressurizing it with a pump and transporting it through an outlet.

Whereas certain forms of the invention have been shown and described it should be understood that this description should be taken in an illustrative or diagrammatic sense only. There are many variations and modifications which will be apparent to those skilled in the art which will not depart from the scope and spirit of the invention. We, therefore, do not wish to be limited to the precise details of construction or operation set forth, but desire to avail ourselves of such variations and modifications as come within the scope of the appended claims.

We claim:

1. A condensor comprising a vapor to be condensed, an upper condensing surface means with a vertical component to its orientation and which is wettable with respect to the condensed state of said vapor, a lower condensing surface means with a vertical component to its orientation and which is unwettable with respect to the condensed state of said vapor, and a condensate collection and removal means, where said upper condensing surface means is placed above said lower condensing surface means such that when a first portion of said vapor condenses and flows down said upper condensing surface means due to the influence of gravity, that its flow will continue off of said upper condensing surface means and onto said lower condensing surface means at a location above a drop-wise condensation region of said lower condensing surface means, where said condensate collection and removal means is placed below said lower condensing surface means such that the condensate which flows down said lower condensing surface means will flow into said condensate collection and removal means for ultimate removal from said condensor.

2. A condensor as in claim 1 where said upper and lower condensing surfaces are tubular in shape and share a common axis.

3. A condensor as in claim 2 where said upper condensing surface means comprises a metal pipe, said lower condensing surface means comprises a plastic tube, where the outer diameter of said metal pipe is approximately the same dimension as the inner diameter of said plastic tube, where said metal pipe is shorter than said plastic tube, and where said metal pipe is inserted into an upper portion of said plastic tube.

4. A condensor as in claim 3 where said metal pipe contains a means of facilitating the flow of condensate between the outer surface of said metal pipe and the inner surface of said plastic tube.

5. A condensor as in claim 4 where said means of facilitating flow comprises groove means in the outer surface of said metal pipe.

6. A condensor as in claim 4 where said means of facilitating flow comprises at least one aperature in a wall of said metal pipe.

7. A condensor as in claim 3 where a heat conductive liquid means is placed between the outer surface of said metallic pipe and the inner surface of said plastic tube and where said heat conductive liquid means is of a different chemical composition than the condensate.

8. A condensor as in claim 7 where said heat conductive liquid means is a silicone-based grease.

9. A condensor as in claim 3 where said upper condensing surface means comprises a metal pipe, said lower condensing surface means comprises a plastic tube, and where the top portion of said plastic tube is fastened with a vapor-tight fastening means to said metallic tube such that the top portion of said metallic tube extends out of the upper end of said plastic tube.

10. A condensor as in claim 1 where said upper condensing surface means and said lower condensing surface means are made out a common material, which normally promotes drop-wise condensation of said vapor on said surfaces, but where said upper condensing surface means has had treatment means to promote film-wise condensation.

11. A method of condensing a vapor comprising the steps of a. introducing a vapor to be condensed into a condensor, where said condensor contains a first condensing surface means which features film-wise condensation with respect to said vapor and a second condensing surface means which features drop-wise condensation with respect to said vapor;

b. condensing a portion of said vapor as a washing fluid onto said first condensing surface means of said condensor;

c. condensing another portion of said vapor as drops on said second condensing surface means;

d. transporting said washing fluid downward on said first condensing surface means with the aid of gravity;

e. transferring said washing fluid to an upper portion of said second condensing surface means with the aid of gravity;

f. transporting said washing fluid downward on said second condensing surface means with the aid of gravity, such that as said washing fluid means flows along a downward path on said second condensing surface means, it combines with said drops which are too small to flow of their own accord, and such that as said combination of said washing fluid and said drops continue their downward flow on said second condensing surface means they leave behind a portion of said second condensing surface means which has been washed free of said drops.

g. collecting said combined washing fluid and said drops as a collected condensate after they have flowed downward together on said second surface means;

h. removing said collected condensate from said condensor.

* * * * *